US007921845B2

(12) United States Patent
Kim

(10) Patent No.: US 7,921,845 B2
(45) Date of Patent: Apr. 12, 2011

(54) MUFFLER OF LINEAR COMPRESSOR

(75) Inventor: Jeong Woo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1595 days.

(21) Appl. No.: 11/191,903

(22) Filed: Jul. 29, 2005

(65) Prior Publication Data

US 2006/0060196 A1 Mar. 23, 2006

(30) Foreign Application Priority Data

Sep. 20, 2004 (KR) ..... 10-2004-0075031

(51) Int. Cl.
*F04B 35/04* (2006.01)
*F04B 11/00* (2006.01)
*F04B 39/10* (2006.01)
*F16K 21/04* (2006.01)

(52) U.S. Cl. ..... 128/204.18; 417/417; 417/540; 417/551; 417/569; 417/570; 137/543.17

(58) Field of Classification Search ..... 417/417, 417/540, 551, 569, 570, 902; 137/543.17
See application file for complete search history.

(56) References Cited

U.S. PATENT DOCUMENTS 5,993,178 A * 11/1999 Park et al. ..... 417/545
6,398,523 B1 * 6/2002 Hur et al. ..... 417/417
2003/0206817 A1 11/2003 Oh et al.
2004/0247457 A1 * 12/2004 Kim et al. ..... 417/312
2006/0093495 A1 * 5/2006 Oh et al. ..... 417/417

FOREIGN PATENT DOCUMENTS

CN 1443279 9/2003
JP 2002 122072 4/2002

OTHER PUBLICATIONS

English language Abstract of JP 2002-122072.
English language Abstract of CN 1443279.

* cited by examiner

*Primary Examiner* — Patricia M Bianco
*Assistant Examiner* — Nihir Patel
(74) *Attorney, Agent, or Firm* — Birch, Stewart, Kolasch & Birch, LLP

(57) ABSTRACT

Disclosed herein is a muffler of a linear compressor. In the present invention, a center of an entry pipe of the muffler is in line with that of an inhale port of a piston. Therefore, a flow loss occurred when fluid is inhaled into the inhale port from the entry pipe can be reduced, and inhale efficiency can be improved. Furthermore, the plurality of inhale ports is eccentrically disposed in a front of the piston, and each center of the plurality of entry pipes is formed to be in line with that of the inhale ports. Not only the center but also the number of the inhale port and the entry pipe are agreed, on this account, the flow loss can be decreased and the inhale volume can be increased.

11 Claims, 7 Drawing Sheets

MUFFLER OF LINEAR COMPRESSOR

BACKGROUND OF THE INVENTION

1. Field of the Invention

The present invention relates to a linear compressor, more particularly, to a muffler of the linear compressor, in which a center of an entry pipe of the muffler is in line with that of an inhale port of a piston, whereby the linear compressor has an effect on reducing a flow loss occurred when fluid is inhaled into the inhale port from the entry pipe.

2. Description of the Related Art

Generally, a linear compressor is a machine to inhale, to compress, and to discharge fluid by linearly reciprocating a piston within a cylinder, by means of linear driving force of a linear motor.

FIG. 1 shows the linear compressor based on the prior art, FIG. 2 shows a muffler of the linear compressor based on the prior art, and FIG. 3 shows a sectional view taken on line A-A of FIG. 2.

The linear compressor according to the prior art, as illustrated from FIGS. 1 to 3, comprises a hermetic casing 2 having an inlet 1 where fluid is entered from the outside, and a linear compression part 10 placed in the hermetic casing 2 to compress fluid.

The linear compression part 10 includes a cylinder block 12 having a cylinder 11, a back cover 14 having an inhale pipe 13, a piston 15 mounted in the cylinder 11 to reciprocally move back and forth, and the linear motor 20 which generates driving force to allow the piston 15 to linearly reciprocate in the cylinder 11.

The cylinder block 12 and the back cover 14 are upheld in the hermetic casing 2 by a main damper 26 and a subsidiary damper 27, so as to absorb a shock.

The linear motor 20 is divided by a stationary part and a movable part. The stationary part includes an outer core 21, an inner core 22 disposed at a regular interval with the outer core 21, and a coil 23 with a magnetic field. The movable part includes a magnet 24 arranged between the outer core 21 and the inner core 22 to linearly reciprocate by magnetic force around the coil 23, and a magnet frame 25 fastened to the magnet 24 and combined with the piston 15 to transmit linear driving force to the piston 15.

The piston 15 has a flange 16 fixed to the magnet frame 25. A main spring 28 is elastically suspended between the flange 16 and the cylinder block 12, and a subsidiary spring 29 is elastically suspended between the flange 16 and the back cover 14.

The piston 15 is provided with an inhale passage 17 where fluid is flowed in, a plurality of inhale ports 18 in front, and an inhale valve 33 to open and close the inhale port 18.

An exhale part is formed in a front of a compression chamber C of the cylinder 11, where compressed fluid is discharged. The exhale part includes an inner exhale cover 34 fixed to the cylinder block 12 and provided with an exhale hole, an exhale valve 36 suspended to the inner exhale cover 34 by the spring 35, so as to open and close the compression chamber C of the cylinder 11, and an outer exhale cover 37 positioned at a regular interval from an outer surface of the inner exhale cover 34.

The outer exhale cover 37 is linked with a loop pipe 38 which guides discharged fluid to the outside of the hermetic casing 2.

The muffler 30 is installed between a back of the piston 15 and the inhale pipe 13 of the back cover 14, so that an inhale noise is mitigated.

Referring to FIG. 2, the muffler 30 comprises a muffler body 31 where the inhale pipe 13 is inserted and a plurality of resonance spaces is configured to reduce the noise, and an entry pipe 32 configured in a long length within the inhale passage 17 of the piston 15, so as to inflow fluid.

The conventional linear compressor operates in the following sequence.

In operation of the linear motor 20, the piston 15 has linearly reciprocating motion within the cylinder 11. Fluid in the hermetic casing 2 is inhaled into the inhale pipe 13 of the back cover 14, is compressed within the cylinder 11 by the piston 15, and is discharged outside from the exhale part and the loop pipe 38.

Here, fluid is inhaled through the inhale pipe 13 of the back cover 14, prior to being inhaled into the inhale passage 17 of the piston 15 after going through the muffler 30. Fluid inhaled into the inhale passage 17 of the piston 15 is flowed into the compression chamber C through the inhale port 18 of the piston 15 by opening the inhale valve 33 when the piston 15 is backed. Fluid contained in the compression chamber C is compressed by closing the inhale valve 33 when the piston 15 is advanced.

However, in which the linear compressor having the conventional muffler, the inhale port 18 of the piston 15 is eccentrically situated in a front of the piston 15, the entry pipe 32 of the muffler 30 is formed toward a center of the piston 15, and a center of the inhale port 18 and that of the entry pipe 32 are out of line each other. When fluid is inhaled into the inhale port 18 from the entry pipe 32, a flow loss is suffered and inhale efficiency is deteriorated.

SUMMARY OF THE INVENTION

Accordingly, it is an aspect of the present invention to provide a muffler of a linear compressor, which prevents a flow loss and improves inhale efficiency, by adjusting a center of an inhale port of a piston to that of an entry pipe of the muffler.

The foregoing and other aspects are achieved by providing the muffler of the linear compressor based on the present invention, wherein the muffler comprises a muffler body mounted in a rear of the piston that has the inhale port in front, and the entry pipe extended from the muffler body to be inserted into the piston. A center of the entry pipe is formed to be in line with that of the inhale port.

A number of the inhale port and the entry pipe is respectively more than one.

The inhale port is eccentrically configured in a front of the piston, and the entry pipe is eccentrically configured in the muffler body.

The muffler body has a plurality of resonance spaces for mitigating a noise.

A diameter of the entry pipe is corresponding to that of the inhale port.

The muffler of the linear compressor in the present invention comprises the muffler body mounted in the rear of the piston that has the inhale port in front, and the entry pipe extended from the muffler body to be inserted into the piston. The inhale port is eccentrically configured in the front of the piston, and the entry pipe is eccentrically configured in the muffler body toward the inhale port.

The number of the inhale port and the entry pipe is respectively more than one.

The plurality of inhale ports is configured, and one entry pipe is configured to face toward the inhale ports.

Both the plurality of inhale ports and entry pipes are respectively configured, and each center of the entry pipes is configured to be in line with that of the inhale ports.

The muffler body has the plurality of resonance spaces for mitigating the noise.

In the present invention providing the muffler of the linear compressor having the above-mentioned construction, the center of the entry pipe of the muffler is in line with that of the inhale port of the piston. With that, the flow loss occurred when fluid is inhaled into the inhale port from the entry pipe can be minimized, and inhale efficiency can be enhanced.

In the present invention providing the muffler of the linear compressor having the above-mentioned construction, the inhale port is eccentrically configured in the front of the piston, and the entry pipe of the muffler is eccentrically configured in the muffler body toward the inhale port. As the entry pipe changes its location, the flow loss occurred when fluid is inhaled into the inhale port from the entry pipe can be minimized, and inhale efficiency can be enhanced.

In the present invention providing the muffler of the linear compressor having the above-mentioned construction, the plurality of inhale ports is eccentrically configured in the front of the piston, and each center of the plurality of the entry pipes is in line with that of the inhale ports. As the center and the number of the inhale port and the entry pipe are agreed, the flow loss can be minimized, and the inhale amount can be enhanced.

BRIEF DESCRIPTION OF THE DRAWINGS

These and other objects and advantages of the present invention will become apparent and more readily appreciated from the following description of the embodiments of the invention, taken in conjunction with the accompanying drawings of which.

DETAILED DESCRIPTION OF THE PREFERRED EMBODIMENT

Figure 1:
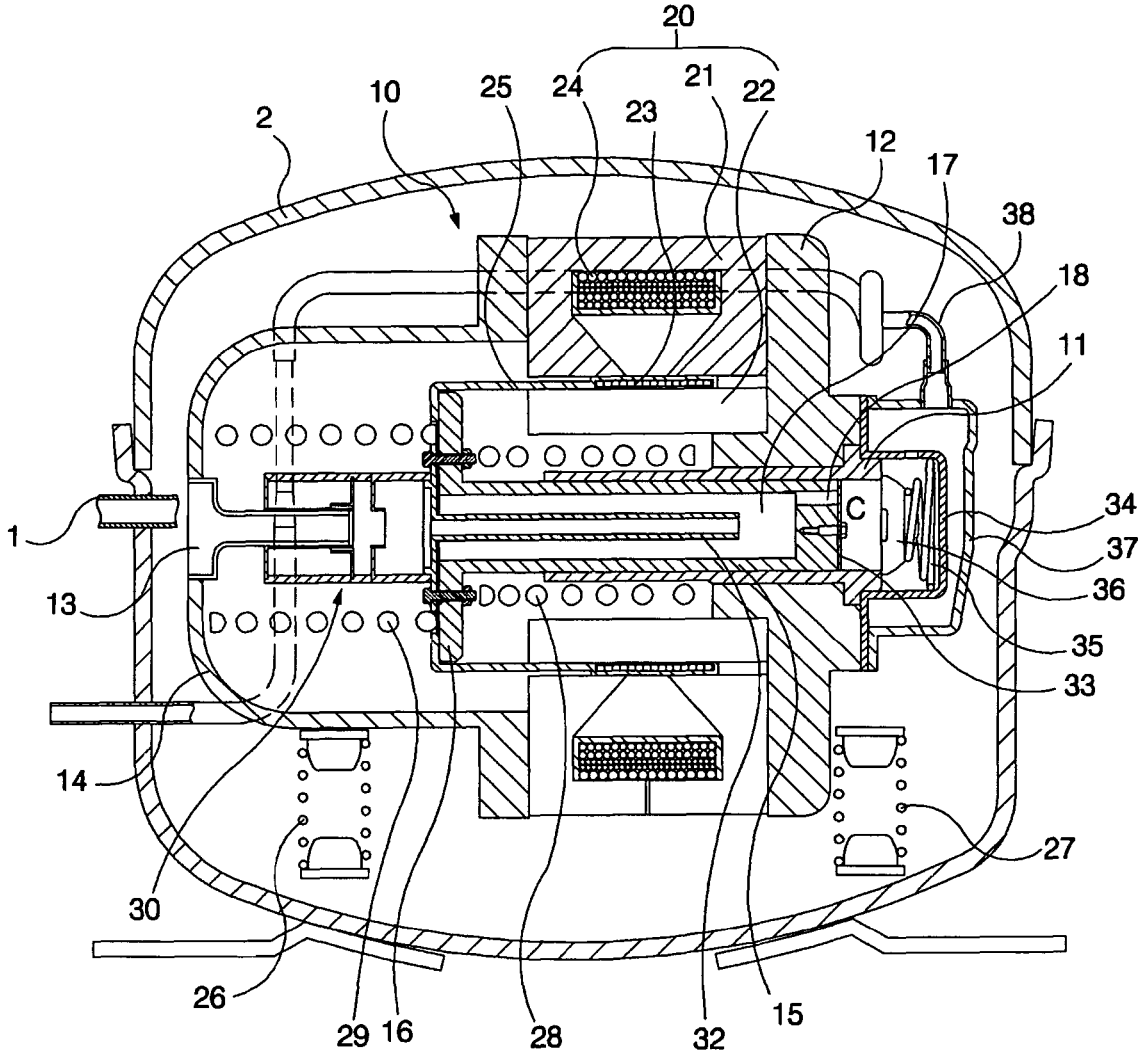
FIG. 1 (Prior Art)
FIG. 1 is a vertically sectional view of a linear compressor, according to the prior art.
Figure 2:
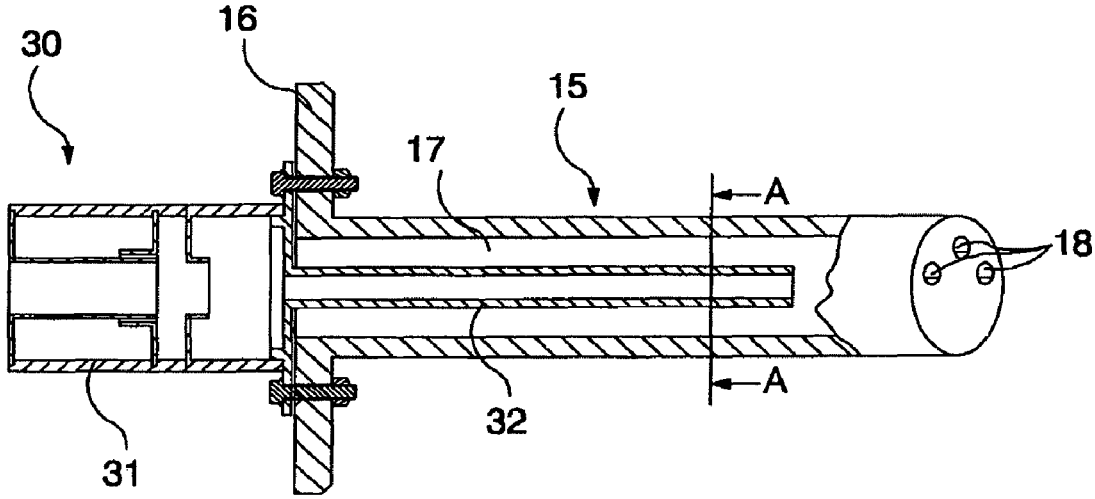
FIG. 2 (Prior Art)
FIG. 2 is an incised perspective view of a muffler of the linear compressor, according to the prior art.
Figure 3:
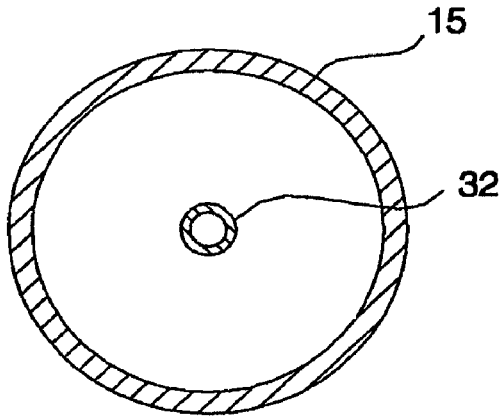
FIG. 3 (Prior Art)
FIG. 3 is a sectional view taken on line A-A of FIG. 2.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 4:
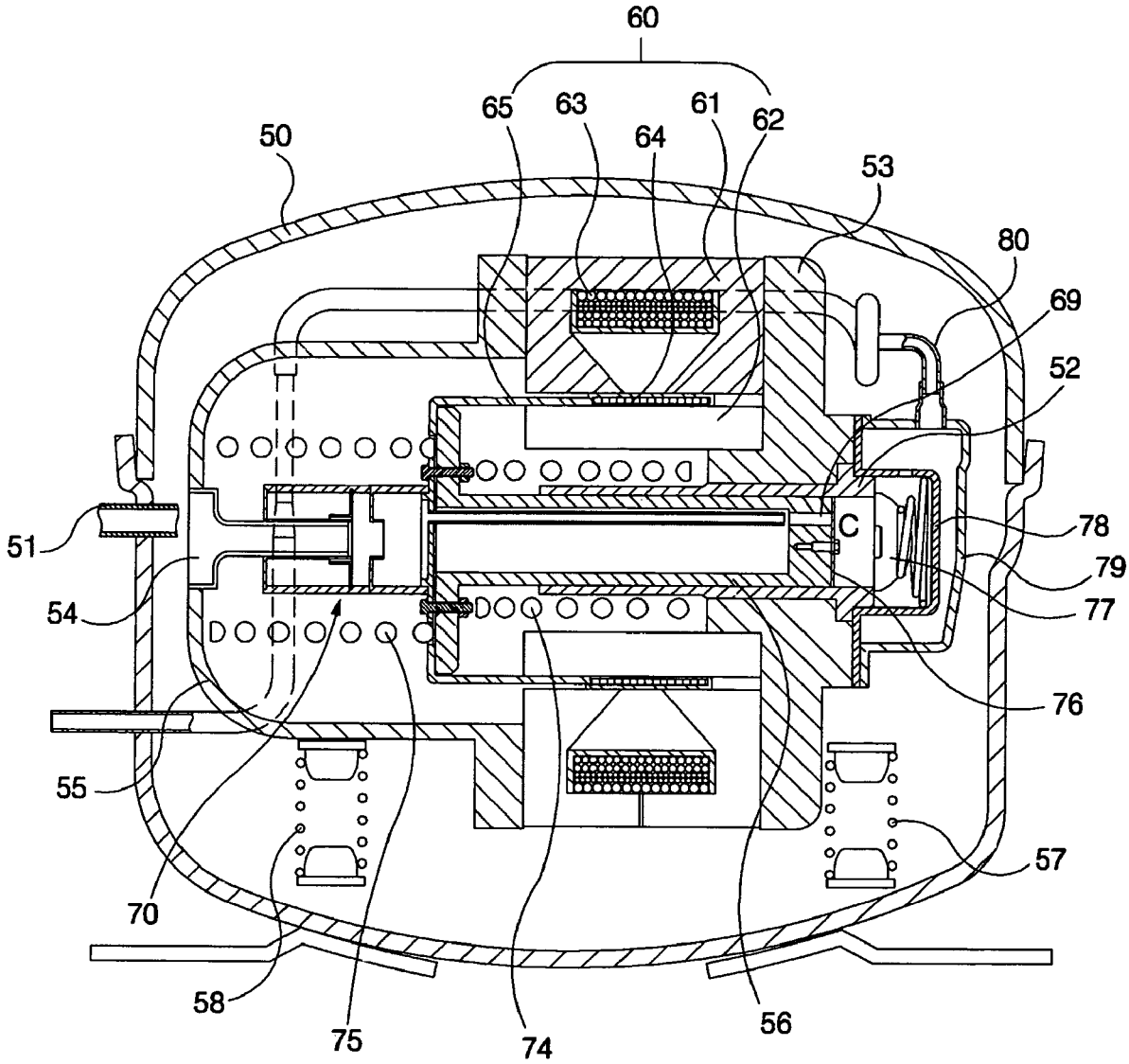
FIG. 4 is a vertically sectional view of the linear compressor, according to a $1^{st}$ embodiment of the present invention.
Figure 5:
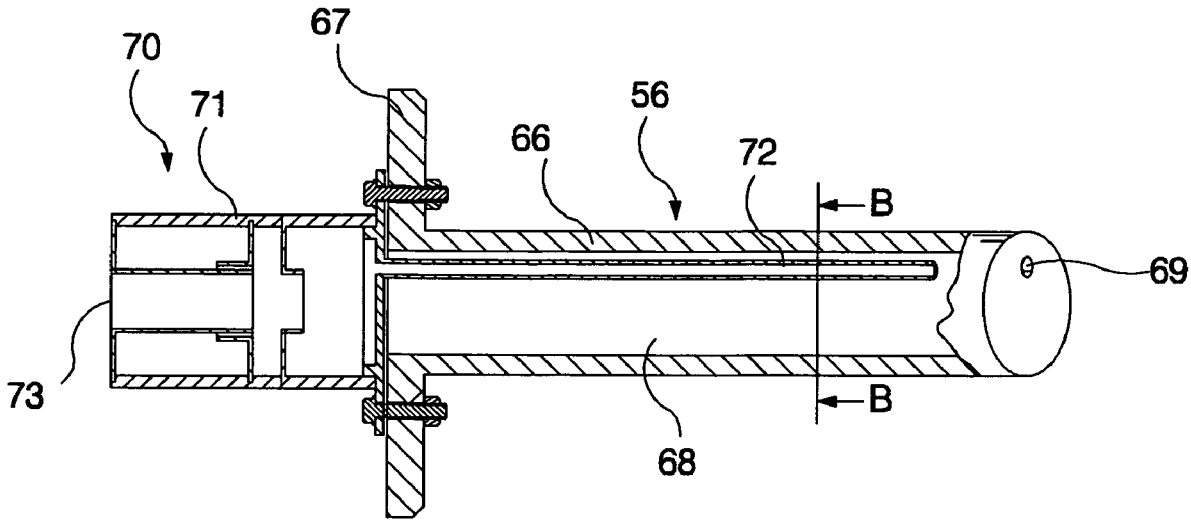
FIG. 5 is an incised perspective view of the muffler of the linear compressor, according to the $1^{st}$ embodiment of the present invention.
Figure 6:
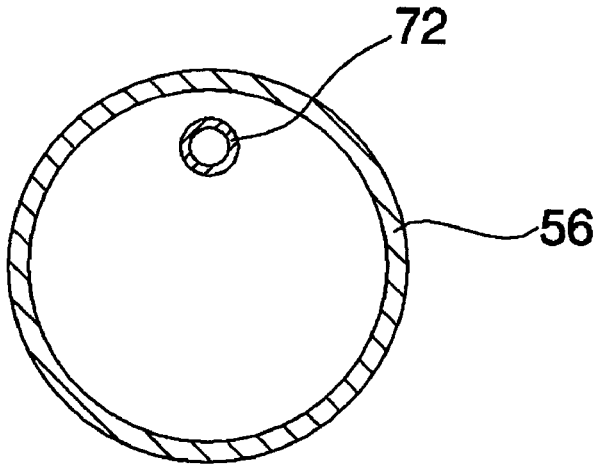
FIG. 6 is a sectional view taken on line B-B of FIG. 5.

FIG. 4 shows a linear compressor, according to a $1^{st}$ embodiment of the present invention, FIG. 5 shows a muffler of the linear compressor, according to the $1^{st}$ embodiment of the present invention, and FIG. 6 shows a sectional view taken on line B-B of FIG. 5.

The muffler of the linear compressor in accordance with the $1^{st}$ embodiment of the present invention, as referring to FIGS. 4 to 6, comprises a hermetic casing 50 having an inlet 51 where fluid is entered from the outside, and a linear compression part housed in the hermetic casing 50 to compress refrigerant. The linear compression part includes a cylinder block 53 having a cylinder 52, a back cover 55 having an inhale pipe 54 that inhales fluid within the hermetic casing 50, a piston 56 set in the cylinder 52 to reciprocally move back and forth, and a linear motor 60 that generates driving force to allow the piston 56 to linearly reciprocate in the cylinder 52.

The cylinder block 53 and the back cover 55 are suspended in the hermetic casing 50 due to a main damper 57 and a subsidiary damper 58, so as to absorb a shock.

The linear motor 60 is divided by a stationary part and a movable part. The stationary part includes an outer core 61, an inner core 62 seated at a regular interval with the outer core 61, and a coil 63 with a magnetic field. The movable part includes a magnet 64 arranged between the outer core 61 and the inner core 62 to linearly reciprocate by magnetic force around the coil 63, and a magnet frame 65 fastened to the magnet 64 and combined with the piston 56 to transmit linear driving force to the piston 56.

The muffler 70 is installed between a back of the piston 56 and the inhale pipe 54 of the back cover 55, so as to reduce a noise.

The piston 56 includes a cylindrical body 66 which linearly reciprocates within the cylinder 52, and a flange 67 protruded outwardly from the body 66 to be fixed to the magnet frame 65.

The body 66 has an inhale passage 68 inside, where fluid is inhaled, and an inhale port 69 in front.

As a main spring 74 is disposed between the flange 67 and the cylinder block 53, and a subsidiary spring 75 is disposed between the flange 67 and the back cover 55, the piston 56 is elastically supported.

One inhale port 69 is eccentrically formed, apart from a frontal center of the piston 56 by predetermined distance.

An inhale valve 76 for opening and closing the inhale port 69 is equipped in a front of the piston 56, which is fastened to the frontal center of the piston 56 by a connection member, such as a bolt.

In front of a compression chamber C of the cylinder 52, an inner exhale cover 78 provided with an exhale valve 77 is installed to discharge compressed fluid. An outer exhale cover 79 is arranged, while being spaced apart from an outer surface of the inner exhale cover 78 by predetermined distance.

The outer exhale cover 79 is linked with a loop pipe 80 which guides discharged fluid to the outside of the hermetic casing 50.

The muffler 70 comprises a muffler body 71 positioned in a rear of the piston 56, an entry pipe 72 extended from the muffler body 71 to be inserted into the piston 56.

An insertion hole 73 is formed in a middle of the muffler body 71, where the inhale pipe 54 of the back cover 55 is inserted. A plurality of resonance spaces is formed around the insertion hole 73, so as to mitigate the noise.

The entry pipe 72 is eccentrically configured, spaced apart from a frontal center of the muffler body 71 by predetermined distance, so that its center is in line with a center of the inhale port 69. The entry pipe 72 is configured only one, as same as the inhale port 69.

A process of the linear compressor according to the 1st embodiment of the present invention is described in the following.

When the linear motor 60 is in operation, the piston 56 is advanced and is retreated from the cylinder 52. Fluid accommodated in the hermetic casing 50 is inhaled into the inhale pipe 54 of the back cover 55, and to the inhale passage 68 of the piston 56. When the inhale valve 76 is opened, it is compressed after being inhaled into the compression chamber C, then is discharged through the inner exhale cover 78, the outer exhale cover 79, and the loop pipe 80 in order.

Here, fluid inhaled through the inhale pipe 54 of the back cover 55 is inhaled into the inhale passage 68 of the piston 56 after going through the muffler body 71 and the entry pipe 72, resulting in reducing the noise thanks to the resonance space of the muffler body 71.

Fluid entered the inhale passage 68 of the piston 56 from the entry pipe 72 is flowed into the cylinder 52 through the inhale port 69 of the piston 56. As a center of the entry pipe 72 and that of the inhale port 69 is in line each other, fluid is smoothly flowed from the entry pipe 72 to the inhale port 69. As a result, a flow loss can be diminished and inhale efficiency can be increased.

Figure 7:
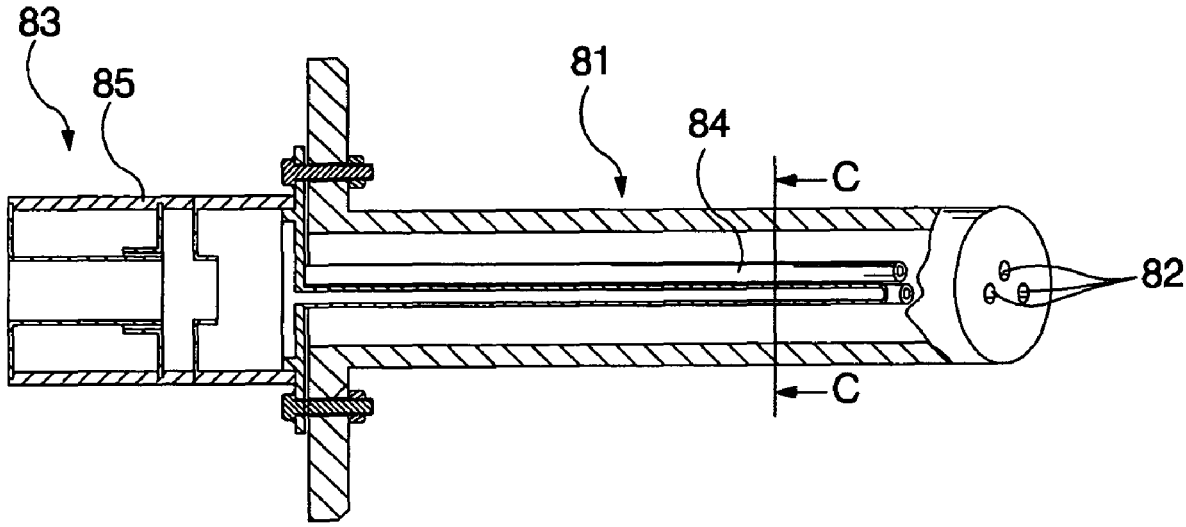
FIG. 7 is an incised perspective view of the muffler of the linear compressor, according to a $2^{nd}$ embodiment of the present invention.
Figure 8:
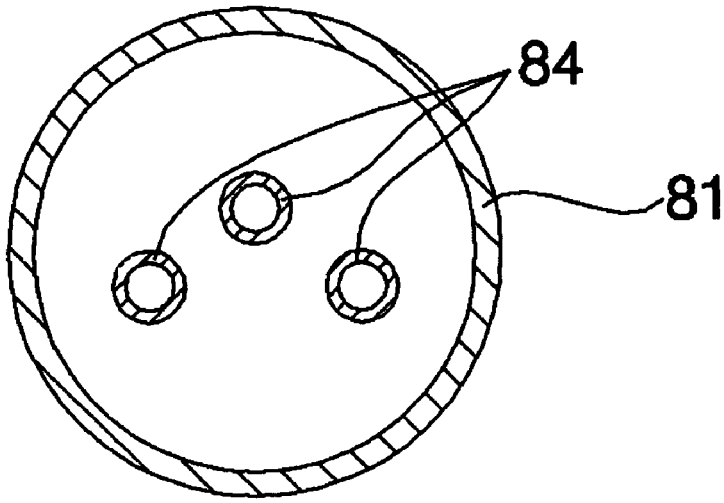
FIG. 8 is a sectional view taken on line C-C of FIG. 7.

FIG. 7 shows the muffler of the linear compressor, according to a 2nd embodiment of the present invention, and FIG. 8 shows a sectional view taken on line C-C of FIG. 7.

The muffler of the linear compressor in accordance with the 2nd embodiment of the present invention, as referring to FIGS. 7 and 8, has the plurality of inhale ports 82 of the piston 81 and the plurality of entry pipes 84 of the muffler 83. Each center of the entry pipes 84 is in line with that of the inhale ports 82. Except that the plurality of inhale ports 82 is placed in the frontal center of the piston 81, and the plurality of entry pipes 84 is placed in the middle of the muffler body 85, other organization and operation are in the same manner as the 1st embodiment. Accordingly, further explanation is not presented to avoid the repetition.

Figure 9:
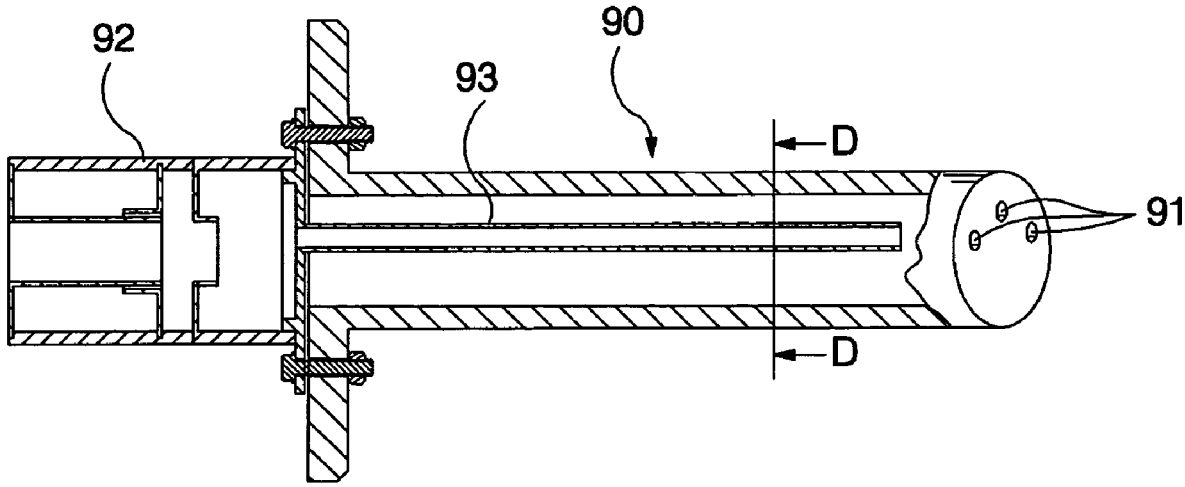
FIG. 9 is an incised perspective view of the muffler of the linear compressor, according to a $3^{rd}$ embodiment of the present invention.
Figure 10:
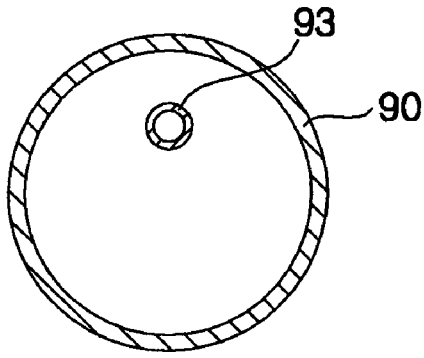
FIG. 10 is a sectional view taken on line D-D of FIG. 9.

FIG. 9 shows the muffler of the linear compressor, according to a 3rd embodiment of the present invention, and FIG. 10 shows a sectional view taken on line D-D of FIG. 9.

The muffler of the linear compressor in accordance with the 3rd embodiment of the present invention, as referring to FIGS. 9 to 10, comprises the muffler body 92 mounted in the rear of the piston 90 having the inhale port 91 in front, and the entry pipe 93 extended from the muffler body 92 to be inserted into the piston 90. The inhale port 91 is eccentrically formed in the front of the piston 90, and the entry pipe 93 is eccentrically formed in the muffler body 92 toward the inhale port 91.

At least one inhale port 91 and at least one entry pipe 93 are configured. As an example, the case that three inhale ports 91 are formed, and one entry pipe 93 is formed to face toward the inhale ports 91 is presented in this study.

Therefore, the flow loss occurred when fluid is flowed into the inhale port 91 through the entry pipe 93 can be reduced.

Not defining the embodiments, it is possible to have more than two entry pipes 93 and to face the plurality of inhale ports 91.

Figure 11:
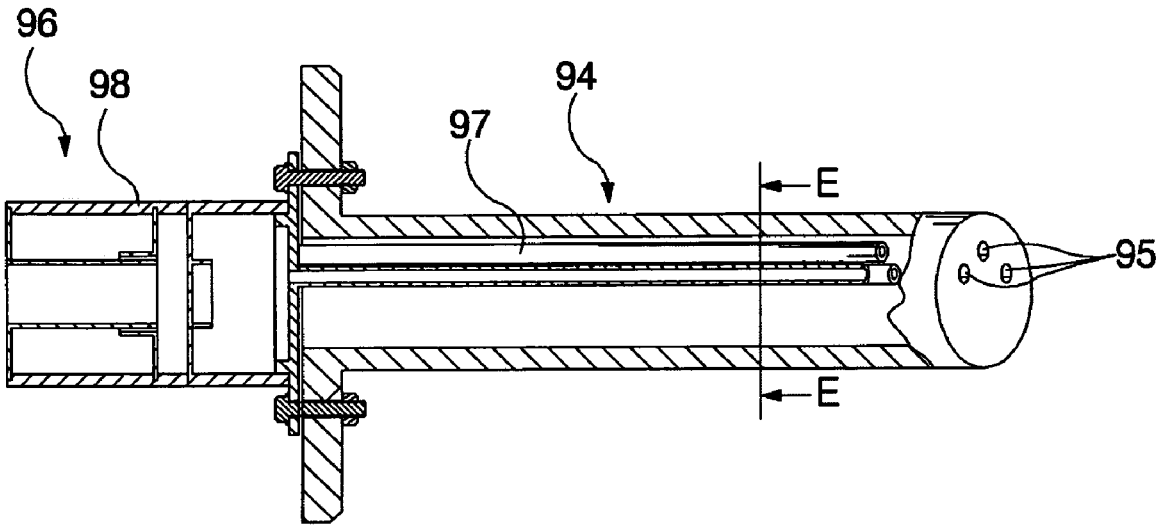
FIG. 11 is an incised perspective view of the muffler of the linear compressor, according to a $4^{th}$ embodiment of the present invention.
Figure 12:
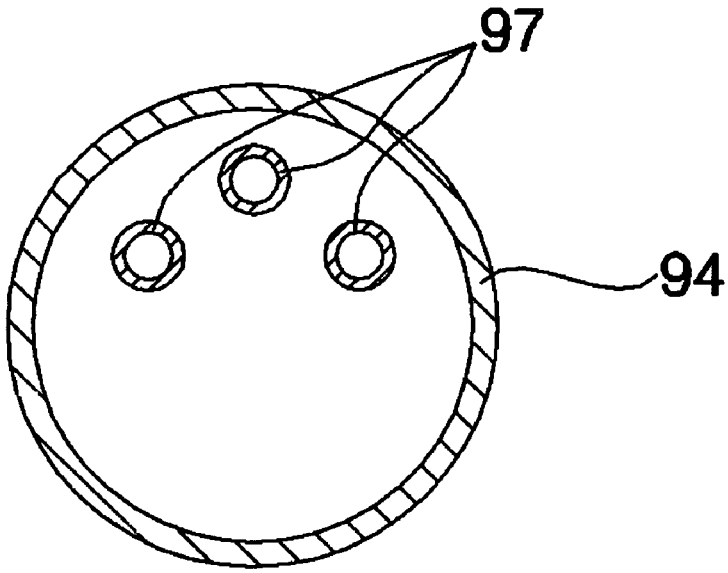
FIG. 12 is a sectional view taken on line E-E of FIG. 11.

FIG. 11 shows the muffler of the linear compressor, according to a 4th embodiment of the present invention, and FIG. 12 shows a sectional view taken on line E-E of FIG. 11.

In the muffler of the linear compressor in accordance with the 4th embodiment of the present invention, the inhale port 95 of the piston 94 is eccentrically formed at a regular interval with the frontal center of the piston 94, and the entry pipe 97 of the muffler 96 is eccentrically formed in the muffler body 98 toward the inhale port 95. Except that the plurality of the inhale ports 95 and the plurality of the entry pipes 97 are configured, and each center of the entry pipes 97 and that of the inhale ports 95 are in line each other, other organization and operation are the same as the 2nd embodiment.

As a result, the flow loss can be decreased and inhale efficiency can be increased as well.

The operational effects of the muffler of the linear compressor according to the present invention are described in the following.

As apparent from the above description, the present invention provides the muffler of the linear compressor. The center of the entry pipe of the muffler is formed to be in line with that of the inhale port of the piston, so that the flow loss occurred when fluid is inhaled into the inhale port from the entry pipe can be reduced, thereby improving inhale efficiency.

As apparent from the above description, the present invention provides the muffler of the linear compressor. The inhale port is eccentrically configured in the front of the piston, and the entry pipe of the muffler is eccentrically configured in the muffler body toward the inhale port. The entry pipe transfers its position, so that the flow loss occurred when fluid is inhaled into the inhale port from the entry pipe can be reduced, thereby improving inhale efficiency.

The plurality of inhale ports is eccentrically configured in the front of the piston, and the center of the plurality of entry pipes is in line with that of the inhale ports. The center and the number of the inhale port and the entry pipe are agreed, so that the flow loss can be reduced. Thus, inhale quantity can be increased.

Although a few embodiments of the present invention have been shown and described, it would be appreciated by those skilled in the art that changes may be made in this embodiment without departing from the principles and spirit of the invention, the scope of which is defined in the claims and their equivalents.

The present disclosure relates to subject matter contained in Korean Application No. 10-2004-0075031, filed on Sep. 20, 2004, the contents of which are herein expressly incorporated by reference in its entirety.

What is claimed is:

1. A muffler of a linear compressor, comprising:

a piston having an inhale port in front;

an inhale valve for opening and closing the inhale port equipped in the front of the piston and placed close to the inhale port;

a muffler body mounted in a rear of the piston; and an entry pipe extended from the muffler body to be inserted into the piston, wherein a center of the entry pipe is formed to be in line with a center of the inhale port, and the inhale port is formed at the piston close to the inhale valve, and wherein a diameter of the entry pipe corresponds to a diameter of the inhale port.

2. The muffler of the linear compressor as set forth in claim 1, wherein at least one inhale port and at least one entry pipe are disposed respectively.

3. The muffler of the linear compressor as set forth in claim 1, wherein the muffler body has a plurality of resonance spaces for reducing a noise.

4. The muffler of the linear compressor as set forth in claim 1, wherein at least one inhale port is eccentrically formed in a front of the piston, and at least one entry pipe is eccentrically formed in the muffler body.

5. A muffler of a linear compressor, comprising:
a hermetic casing;
a linear motor set in the hermetic casing;
a cylinder block installed in a front of the linear motor;
a back cover installed in a rear of the linear motor;
a piston mounted in a cylinder of the cylinder block to reciprocally move back and forth, said piston having an inhale port in front;
a muffler arranged between a rear of the piston and the back cover; and
an inhale valve for opening and closing the inhale port equipped in the front of the piston and placed close to the inhale port;
wherein the muffler comprises:
a muffler body mounted in the rear of the piston; and
an entry pipe extended from the muffler body to be inserted into the piston, said entry pipe being eccentrically formed in the muffler body toward the inhale port formed at the piston closer to the inhale valve, and
wherein the plurality of inhale ports and the plurality of entry pipes are formed, each center of the entry pipes is in line with each center of the inhale ports.

6. The muffler of the linear compressor as set forth in claim 5, wherein at least one inhale port and at least one entry pipe are disposed respectively.

7. The muffler of the linear compressor as set forth in claim 5, wherein the muffler body has a plurality of resonance spaces for reducing a noise.

8. A muffler of a linear compressor, comprising:
a piston having a front end and a rear end;
a first inhale port located at the front end of the piston;
a muffler body located at the rear end of the piston; and
a first entry pipe extending from the muffler body and into the piston,
wherein a center of the first entry pipe is aligned with a center of the first inhale port, and
wherein the piston has a length defined between the front end of the piston and the rear end of the piston, and the first entry pipe extends along a majority of the length of the piston.

9. The muffler of the linear compressor as set forth in claim 8, further comprising an inhale valve located at the front end of the piston for opening and closing the first inhale port.

10. A muffler of a linear compressor, comprising:
a piston having a front end and a rear end;
a first inhale port located at the front end of the piston;
a muffler body located at the rear end of the piston; and
a first entry pipe extending from the muffler body and into the piston,
wherein a center of the first entry pipe is aligned with a center of the first inhale port, and
wherein a central longitudinal axis of the first entry pipe is offset from a central longitudinal axis of the piston.

11. A muffler of a linear compressor, comprising:
a piston having a front end and a rear end;
a first inhale port located at the front end of the piston;
a muffler body located at the rear end of the piston; and
a first entry pipe extending from the muffler body and into the piston,
wherein a center of the first entry pipe is aligned with a center of the first inhale port, and
further comprising:
a second inhale port located at the front end of the piston; and
a second entry pipe extending from the muffler body and into the piston,
wherein a center of the second entry pipe is aligned with a center of the second inhale port.

* * * * *